US009473853B2

(12) United States Patent
Huang

(10) Patent No.: US 9,473,853 B2
(45) Date of Patent: Oct. 18, 2016

(54) ACOUSTIC UNIT, LOUDSPEAKER AND ACOUSTIC MODULE HAVING THE SAME, AND MANUFACTURING METHOD THEREOF

(71) Applicant: Tang Band Industries Co., Ltd., Ningbo (CN)

(72) Inventor: Hsin Min Huang, Ningbo (CN)

(73) Assignee: Tang Band Industries Co., Ltd., Ningbo, Zhejiang (CN)

( * ) Notice: Subject to any disclaimer, the term of this patent is extended or adjusted under 35 U.S.C. 154(b) by 0 days.

(21) Appl. No.: 14/398,727

(22) PCT Filed: Nov. 13, 2013

(86) PCT No.: PCT/CN2013/087067

§ 371 (c)(1),
(2) Date: Nov. 3, 2014

(87) PCT Pub. No.: WO2014/075611

PCT Pub. Date: May 22, 2014

(65) Prior Publication Data

US 2015/0110303 A1 Apr. 23, 2015

(30) Foreign Application Priority Data

Nov. 14, 2012 (CN) ..... 2012 1 0458575

(51) Int. Cl.

| | |
|---|---|
| ***H04R 1/02*** | (2006.01) |
| ***H04R 7/04*** | (2006.01) |
| ***H04R 1/00*** | (2006.01) |
| ***H04R 7/20*** | (2006.01) |
| *H04R 9/06* | (2006.01) |

(52) U.S. Cl.

CPC *H04R 7/04* (2013.01); *H04R 1/00* (2013.01); *H04R 7/20* (2013.01); *H04R 9/06* (2013.01); *H04R 2231/001* (2013.01); *H04R 2231/003* (2013.01); *H04R 2307/207* (2013.01)

(58) Field of Classification Search

CPC .... H04R 7/16; H04R 2307/201; H04R 1/24; H04R 2400/03; H04R 1/2807; H04R 1/2815; H04R 1/283

USPC ..... 381/345, 349, 162, 351

See application file for complete search history.

(56) References Cited

U.S. PATENT DOCUMENTS

2009/0245561 A1* 10/2009 Litovsky ..... H04R 1/2834 381/345

* cited by examiner

*Primary Examiner* — Sunita Joshi

(74) *Attorney, Agent, or Firm* — Raymond Y. Chan; David and Raymond Patent Firm

(57) ABSTRACT

An acoustic unit, which is arranged for coupling with a vibration system to produce an audio sound, includes a frame, a vibration member for being reciprocatingly moved in response to the vibration system; and a resilient suspension which is provided around the vibration member and is located between the vibration member and the frame, wherein the suspension has a stretching section integrally extended from the vibration member and a cushioning section integrally extended from the stretching section to the frame. The cushioning section only allows the stretching section to displace along a direction the same as a vibration direction of the vibration member to restrict a vibrating movement of the vibration member. The acoustic unit is incorporated with an acoustic module, wherein when a loudspeaker of the acoustic module operates, the acoustic unit synchronously vibrates to provide an enhanced low frequency audio effect.

12 Claims, 16 Drawing Sheets

A-A

B-B

C-C

ACOUSTIC UNIT, LOUDSPEAKER AND ACOUSTIC MODULE HAVING THE SAME, AND MANUFACTURING METHOD THEREOF

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to an acoustic unit for generating sound effect, and more particular to the acoustic unit incorporating with a loudspeaker or an acoustic module and its manufacturing method thereof, wherein the acoustic unit comprises a suspension to minimize a vibration thereof so as to enhance the audio quality produced by the acoustic unit, especially the audio at low frequency.

2. Description of Related Arts

A vibration system of a conventional loudspeaker generally includes a vibration plate, a voice coil, and a magnetic coil system. The voice coil is disposed in the magnetic coil system to magnetically induce with the magnetic coil system, a vibration of the vibration plate is thus produced and the vibration is controlled by a resilient suspension of the vibration plate, and thus an audio effect is produced by the loudspeaker. According to the conventional art, no matter the suspension is constructed to have a square shape or race-track like shape, when the vibration plate moves up and down at a relatively large vibration amplitude, a weight member at the center of the vibration plate will concurrently moves in an up-and-down direction and in a planar manner. As a result, the suspension will be easily deformed in response to the pulling and tearing force during the vibration. The problem is commonly found in the racetrack shaped suspension. Since the suspension is unable to move up and down in a balanced vertical manner, shaking of the vibration plate is thus inevitable. In other words, the sound produced by the vibration plate will not be clear.

The sound quality at the low-frequency is determined by the displacement and vibration frequency of the vibration plate. When a relatively large low-frequency audio signal is input, the vibration plate will moves up and down violently. At the largest displacement-position of the vibration plate, corners of the racetrack shaped suspension will be substantially pulled, such that the tearing force will be concentrated and exerted at the corners of the suspension. The mechanism can be better understood with the following description. When the racetrack shaped suspension is placed at a horizontal orientation and is pressed by a hand to cause the vibration plate to move downwardly, it can be viewed that the four corners of the suspension are the most seriously deformed locations to be pulled. In other word, the displacement of the entire vibration plate will be restricted by the four corners. Since the displacement of the vibration plate will be restricted at the corners of the suspension, and the desired low-frequency audio quality of the loudspeaker cannot be obtained. In addition, the displacement of the vibration plate must be increased if a better low-frequency audio quality is required. This means that the volume and size of the acoustic enclosure and/or loudspeaker should be relatively large enough, and thus it is not convenient for storage and transportation.

SUMMARY OF THE PRESENT INVENTION

The main object of the present invention is to provide an acoustic unit incorporating in a loudspeaker or an acoustic module, and a manufacturing method thereof, wherein the suspension of the acoustic unit will not move in an unbalance manner to reduce the vibration of a vibration member of the acoustic unit, so that a clear and pure audio is produced.

Another object of the present invention is to provide an acoustic unit incorporating in a loudspeaker or an acoustic module, and a manufacturing method thereof, wherein the resilient suspension is provided around the vibration member and is located between the vibration member and a frame. The resilient suspension is extended above or is higher than the vibration member to evenly distribute the puling force from the vibration member during the vibration, so that the resilient suspension is not easy to damage and the vibration member moves in a vertical or a horizontal direction in a balancing manner, and thus the audio quality will be ensured.

Another object of the present invention is to provide an acoustic unit incorporating in a loudspeaker or an acoustic module, and a manufacturing method thereof, wherein a corrugated stretching section of the suspension of the acoustic unit drives the vibration member to vibrate, and a cushioning section of the suspension provides a cushion effect to the stretching section in such a manner that the pulling force of the vibration member will not be transferred to a connection section which is provided between the corrugated cushioning section of the suspension and the frame, so that the vibration of the vibration member will not be transferred to the frame, and thus the frame will not limit the displacement of the vibration member. Therefore, the vibration member vibrates under the guidance of the resilient force of the suspension to achieve a desired displacement.

Another object of the present invention is to provide an acoustic unit incorporating in a loudspeaker or an acoustic module, and a manufacturing method thereof, wherein a gap is formed between the cushioning section and the frame, the corrugated stretching section of the suspension is integrally extended from the vibration member, so that the corrugated cushioning section of the suspension provides a cushioning space for the stretching section of the suspension, and thus the suspension will not suffer an excessive puling force to cause a violent deformation and damage.

Another object of the present invention is to provide an acoustic unit incorporating in a loudspeaker or an acoustic module, and a manufacturing method thereof, wherein inner corners of the frame is constructed to be arc shaped, the arches or corrugations of the suspension corresponding to the inner corners is constructed to be higher than peripheral edges of the vibration member, so that an even higher cushioning effect is provided to the corners by the suspension, and thus the vibration of the vibration member will not be seriously influenced by the portion of the suspension corresponding to the corners and the vibration member is thus provided with a relatively large displacement.

Another object of the present invention is to provide an acoustic unit incorporating in a loudspeaker or an acoustic module, and a manufacturing method thereof, wherein when the acoustic unit is incorporated with a base frame, a voice coil, a magnetic coil system, and other necessary components to provide the loudspeaker, the suspension enables the relative large displacement of the vibration member and the suspension is not easy to damage, so that the loudspeaker is provided with enhanced audio quality, especially enhanced low-frequency audio quality.

Another object of the present invention is to provide an acoustic unit incorporating in a loudspeaker or an acoustic module, and a manufacturing method thereof, wherein the acoustic module comprises at least one loudspeaker and at least one acoustic unit, so that when the loudspeaker vibrates to produce a sound, the air in the acoustic module vibrates to drive the acoustic unit to vibrate, so that low-frequency audio performance of the acoustic module is enhanced. In other words, the acoustic unit provides a function of enhancing the low-frequency audio performance of the acoustic module.

Another object of the present invention is to provide an acoustic unit incorporating in a loudspeaker or an acoustic module, and a manufacturing method thereof, wherein the acoustic module can be provided with better low-frequency audio performance via the acoustic unit, so that complicated design of the interior structure of the acoustic module is not required, the volume and size of the acoustic module can be minimized and the thickness of the acoustic module can be decreased, so that the acoustic module is convenient for storage and transportation.

Another object of the present invention is to provide an acoustic unit incorporating in a loudspeaker or an acoustic module, and a manufacturing method thereof, wherein the frame, the suspension and the vibration member are integrated to form a one-piece structure in a mold, so that the manufacturing process is easy and the manufacturing cost is low.

Additional advantages and features of the invention will become apparent from the description which follows, and may be realized by means of the instrumentalities and combinations particular point out in the appended claims.

According to the present invention, the foregoing and other objects and advantages are attained by an acoustic unit, which is arranged for coupling with a vibration system to produce an audio sound, comprising a frame, a vibration member which is adapted for vibrating in response to vibration of the vibration system; and a resilient suspension which is provided around the vibration member in such a manner that the resilient suspension is located between the vibration member and the frame, wherein the suspension prevents shake of the vibration member so as to provide a pure audio effect.

According to an embodiment of the present invention, the vibration system comprises a magnetic coil system and a voice coil, wherein during a vibration operation of the magnetic coil system and the voice coil, the vibration member is driven by the voice coil to vibrate so as to produce the audio effect.

According to an embodiment of the present invention, the vibration system comprises at least one loudspeaker, wherein vibration of the loudspeaker drives the vibration member of the acoustic unit to vibrate so as to produce the audio effect.

According to an embodiment of the present invention, the vibration system comprises one the loudspeaker, wherein the loudspeaker defines a first chamber, a second chamber which is communicated with the first chamber, and comprises a vibration plate, wherein when the vibration plate vibrates to drive air in the first chamber to vibrate, air in the second chamber is driven to vibrate and the vibration member of the acoustic unit is driven to vibrate by the air in the second chamber.

According to an embodiment of the present invention, the vibration system comprises two the loudspeakers which are spacedly aligned with each other, wherein the acoustic unit is provided at a position between the two loudspeakers, wherein when the two loudspeakers are in a vibration operation, the vibration member of the acoustic unit is driven to vibrate to provide a supplemental low frequency audio effect.

According to an embodiment of the present invention, the suspension comprises a stretching section and a cushioning section, wherein the stretching section is integrally and outwardly extended from the vibration member, wherein the cushioning section is integrally extended from the stretching section to the frame in such a manner that the cushioning section only allows the stretching section to displace along a direction the same as a vibration direction of the vibration member when the stretching section and the vibration member are in the vibration operation, so that incline movement and shake of the vibration member is prevented.

According to an embodiment of the present invention, the cushioning section is outwardly extended from the frame, and the stretching section is outwardly extended from an outer edge of the vibration member in such a manner that a ring groove is defined between the cushioning section and the stretching section, wherein a joining part of the cushioning section and the stretching section is located above a plane of an outer surface of the vibration member.

According to an embodiment of the present invention, the cushioning section and the stretching section is integrated with each other to form a one-piece structure.

According to an embodiment of the present invention, the vibration member has at least one corner, wherein a joining part of the cushioning section and the stretching section corresponding to the corner is located above a plane of an outer surface of the frame.

According to an embodiment of the present invention, the suspension further comprises a connecting section connected to the frame, wherein the connecting section is extended from the cushioning section to an inner surface of the frame in such a manner that a cushioning groove is defined between the inner surface of the frame and the cushioning section, wherein when the vibration member and the stretching section are in the vibration operation, a pulling force of the vibration member is not transferred to the connecting section by means of a cushioning effect of the cushioning section, so that the cushioning section does not move and the suspension is not easy to be distorted and damaged.

According to an embodiment of the present invention, the suspension is constructed to form a shape selected from a group consisting of a corrugated shape, an arch shape, and a wave shape.

According to an embodiment of the present invention, the vibration member is formed with a shape selected from a group consisting of a round shape and a polygonal shape.

According to an embodiment of the present invention, the vibration system and the frame are respectively coated with a resilient material layer which is made of material the same as material of the suspension.

The present invention further provides a loudspeaker, comprising:

a base frame;

a magnetic coil system;

a voice coil coupled with the magnetic coil system; and an acoustic unit which comprises:

a frame;

a vibration member; and a resilient suspension, wherein the suspension is provided around the vibration member in such a manner that the suspension is extended between the frame and the vibration member, wherein the frame is integrated with the base frame, wherein during a vibration operation of the voice coil and the magnetic coil system, the vibration member is driven to vibrate, and the suspension is arranged for preventing shake of the vibration member so as to produce a pure audio effect.

In accordance with another aspect of the invention, the present invention comprises an acoustic module, comprising:

at least one loudspeaker; and at least one acoustic unit which is provided adjacent to said loudspeaker, wherein said acoustic unit comprises:

a frame;

a vibration member; and a resilient suspension, wherein said suspension is provided around said vibration member in such a manner that said suspension is extended between said frame and said vibration member, wherein during a vibration operation of said loudspeaker, said vibration member is driven to vibrate, and said suspension is arranged for preventing shake of said vibration member so as to produce a pure audio effect.

The present invention further provides a manufacturing method of an acoustic unit, wherein the method comprises the following steps.

(a) Place a ring shaped frame in a shape forming mold.

(b) Place a vibration member within the ring shaped frame.

(c) Mold the vibration member with the frame in such a manner that a resilient suspension is extended between the vibration member and the frame.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIG. 1A to FIG. 6 of the drawings, an acoustic unit 10 according to a preferred embodiment of the present invention is illustrated, wherein the acoustic unit 10 is adapted for providing a vibration performance in response to an action of a vibration system, so as to drive the air around the acoustic unit 10 to vibrate in order to produce an audio sound. The vibration system can be an arrangement which comprises a voice coil and a magnetic coil system of a loudspeaker. In another example, the vibration system can be an integral loudspeaker that the acoustic unit 10 is employed to provide an auxiliary audio effect for the integral loudspeaker, the detailed description will be illustrated in the following disclosure.

The acoustic unit 10 comprises a central vibration member 11, a resilient suspension 12 provided around the vibration member 11, and a frame 13. The suspension 12 is provided between the vibration member 11 and the frame 13. Since the suspension 12 is made of resilient material, when the acoustic unit 10 is located in a vibration energy field, i.e. there are vibration waves around the acoustic unit 10, more specifically, with the impact of the energy wave produced by the vibrating air, the vibration member 11 is driven by the suspension 12 to vibrate so as to produce the audio sound.

Figure 1A:
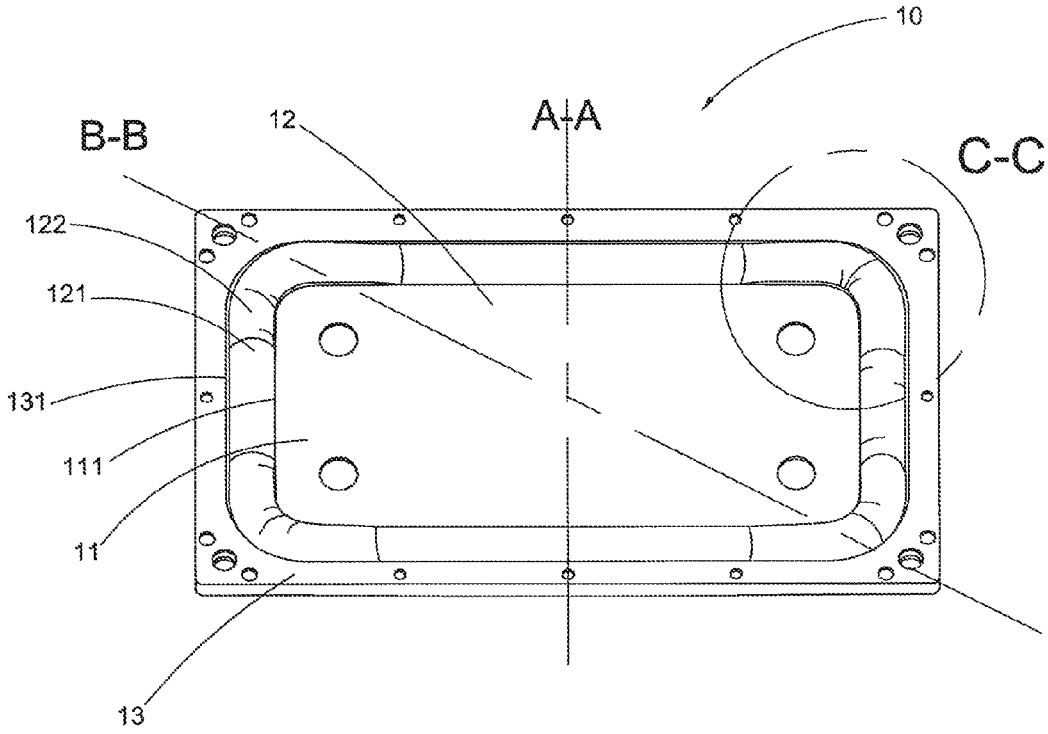
FIG. 1A is a perspective view of an acoustic unit according a preferred embodiment of the present invention.
Figure 1B:
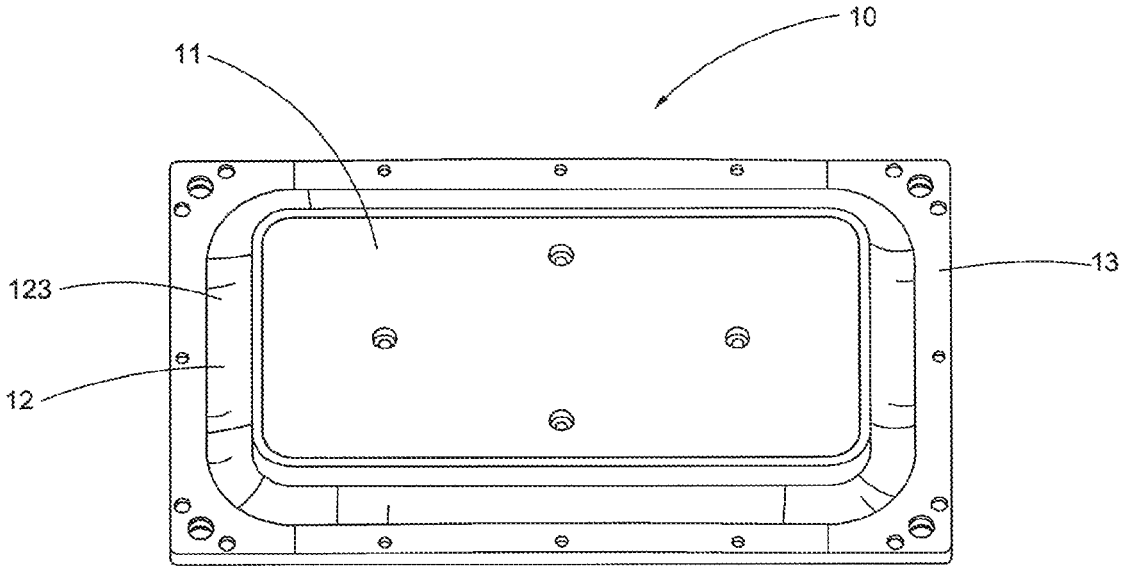
FIG. 1B is another perspective view illustrating the acoustic unit according to the above preferred embodiment of the present invention.

FIGS. 1A and 1B are perspective views illustrating the front and rear side of the acoustic unit 10 respectively. It is thus seen that the suspension 12, which can be formed in a corrugated shape, is extended between the vibration member 11 and the frame 13. In other words, the suspension 12 is not flatly extended between the vibration member 11 and the frame 13. Therefore, the suspension 12 ensures the vibration member 12 to vibrate and prevents the unbalanced vibration of the vibration member 12 which distorts the resulting sound.

More specifically, as shown in FIG. 1A of the drawings, the suspension 12 comprises a stretching section 121 and a cushioning section 122 (or buffering section). The stretching section 121 is integrally and outwardly extended from an outer peripheral edge 111 of the vibration member 11. More specifically, the stretching section 121 can be curvedly and outwardly extended from the outer peripheral edge 111 of the vibration member 11. The cushioning section 122 is integrally and inwardly extended from the stretching section 121. In other words, the cushioning section 122 is outwardly extended from an inner surface 131 of the frame 13 and is joined with the stretching section 121 to form the corrugated suspension 12.

In this preferred embodiment, the stretching section 121 and the cushioning section 122, which are provided around the vibration member 12, can form an arch like structure. The stretching section 121 is provided adjacent to the vibration member 11 and the cushioning section 122 is provided adjacent to the frame 13. As shown in FIG. 1B of the drawings, the stretching section 121 and the cushioning section 122 are integrally extended from each other in such a manner that an arc-shaped groove 123 is formed between the vibration member 11 and the frame 13 and is upwardly protruded from the acoustic unit 10 while the vibration member 11 is positioned underneath the suspension 12.

During a vibration period, the vibration member 11 moves in two opposite directions, i.e. up-and-down direction or front-and-back directions, and finally returns to its original position. Assuming that the acoustic unit 10 is positioned horizontally, the vibration member 11 will displace along the upward and downward directions, the stretching section 121 moves upwardly and downwardly together with the vibration member 11 to enable the vibration member 11 to move at the largest displacement, i.e. the uppermost and lowermost positions. Since the stretching section 121 is evenly provided around the vibration member 11, the pulling force from the vibration member 11 can be evenly distributed. In addition, the configuration of the cushioning section 122 provides an opposed supporting force to the stretching section 121, so that the resilient suspension will just move in the straight upward and downward directions to prevent any unwanted lateral vibration or any movement at other directions. Thus the resilient suspension 12 will not easy to damage because of the impact of the pulling force of the vibration member 11. In other words, in the vibration period of the vibration member 11, the suspension 12 will not be applied with a force in a direction different from the vibration direction, so that the suspension 12 and the vibration member 11 both displace in the vibration direction.

Referring to FIGS. 2 to 6 of the drawings, when the vibration member 11 moves to the position of the largest displacement in one vibration cycle, the stretching section 121 pulls the cushioning section 122 to the most extent. However, the cushioning section 122 still will not apply a pulling force to the inner surface 131 of the frame 13. In other words, when the suspension 12 is in a deforming process, the pulling force will not transfer to a joining portion between the inner surface 131 of the frame 13 and the cushioning section 122. Therefore, the suspension 12 is not easy to be damaged while the large enough displacement of the vibration member 11 is also ensured. In other words, a relative large length of stroke of the acoustic unit 10 is ensured, so that an enhanced quality of the low-frequency audio is obtained. Since the suspension 12 is provided with a corrugated configuration, the stretching section 121 and the cushioning section 122 can be formed in an arch shape, so as to not only drives the vibration member 11 to vibrate in the vibration direction, but also prevents the shake along other directions so that the audio quality of the acoustic unit 10 is ensured.

Figure 2:
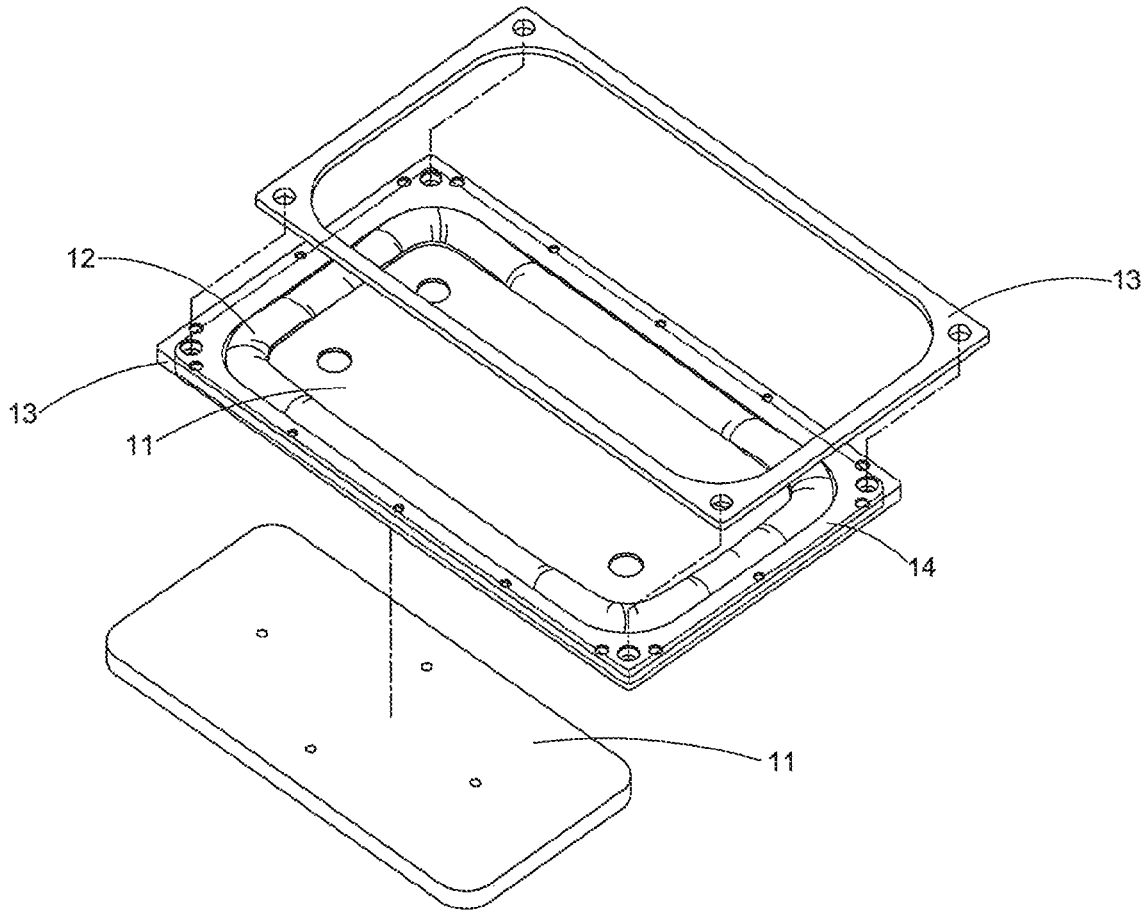
FIG. 2 is an exploded view of the acoustic unit according to the above preferred embodiment of the present invention.

FIG. 2 is an exploded perspective view of the acoustic unit 10 according to this preferred embodiment of the present invention, the frame 13 and the vibration member 11 can be coated with a resilient material layer 14 which can be made of material the same with the material of the suspension 12, for example, the material can be plastic. Therefore, the suspension 12, the frame 13 and the vibration member 11 can be integrally and seamlessly formed to enhance the entire performance of the acoustic unit 10.

Figure 3:
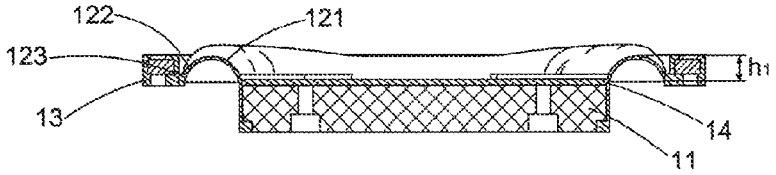
FIG. 3 is a sectional view along line A-A in FIG. 1A.
Figure 4:
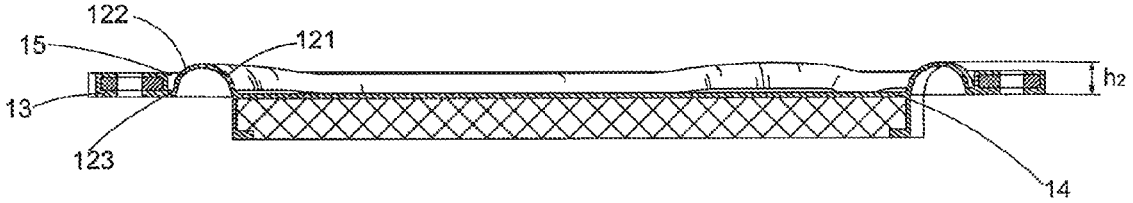
FIG. 4 is a sectional view along line B-B in FIG. 1A.
Figure 5:
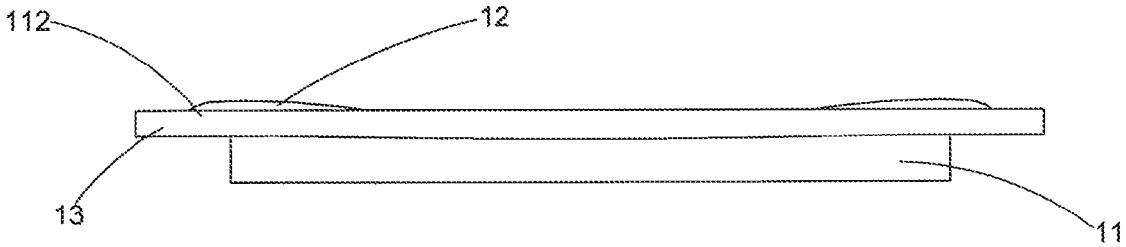
FIG. 5 is a sectional view of the acoustic unit according to the above preferred embodiment of the present invention.
Figure 6:
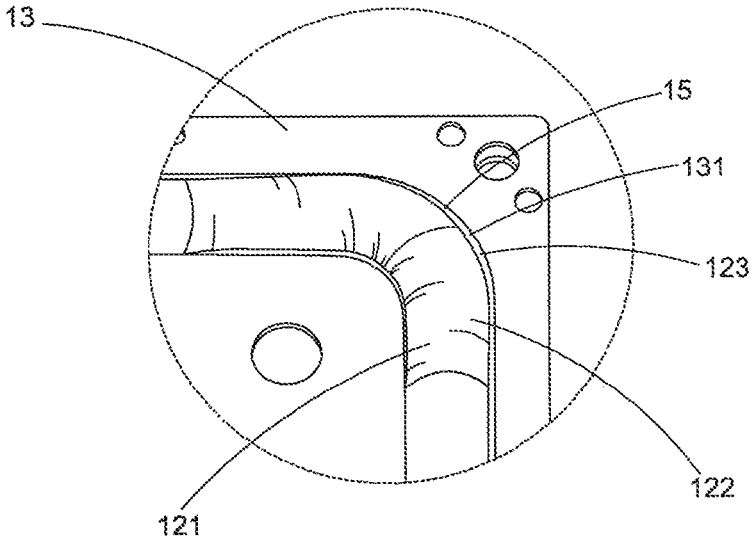
FIG. 6 is an enlarged partial view of C in FIG. 1A.

FIGS. 3 and 4 are respectively views along line A-A and B-B in FIG. 1A, the stretching section 121 is smoothly extended from the outer edge of the vibration member 11 and is constructed to be arc-shaped, and the cushioning groove 15 is provided between the cushioning section 122 and the frame 13. More specifically, as shown in FIG. 6, the suspension 12 comprises a connecting section 123 joined with the frame 13. The connecting section 123 is extended from the cushioning section 122 to the inner surface 131 of the frame 13 so as to form the cushioning groove 15 between the inner surface 131 of the frame 13 and the cushioning section 122.

In other words, when the vibration member 11 is vibrating in one vibration cycle, the stretching section 121 and the cushioning section 122 of the suspension 12 will displace and deform correspondingly. However, the deformation of the cushioning section 122 will not apply a pulling force to the connecting section 123. In other words, the pulling force exerted from the vibration member 11 during its vibration will not be transferred to the connecting section 123. The cushioning section 122 and the stretching section 123 cooperate with each other to guide the vibration member 11 to complete the vibration cycle and minimize the deformation of the suspension 12 to the most extent, so that the suspension 12 will not easy to slip off from the frame 13 or to be damaged. In addition, this type of structure can help to enhance the audio quality of the acoustic unit 10, especially the audio quality at the low-frequency.

Referring to FIGS. 3 and 4 of the drawings, the vibration member 11 of this preferred embodiment can be embodied as a weight member and can be formed in a rectangular shaped with four corners 112. It is worth mentioning that the width and height of the portions of the suspension 12 corresponding to the corners 112 of the vibration member 11 are increased, so that the suspension 12 will not be pulled violently by the four corners 112 of the vibration member 11 and distort seriously while the vibration member 11 is vibrating.

Referring to FIG. 4 of the drawings, the cushioning section 122 and the stretching section 121 of the suspension 12 of this preferred embodiment can be formed in an arch configuration, and the locations corresponding to the corners 112 may have an arch height h2 larger than an arch height h1 of other locations. As shown in FIG. 4 of the drawings, the portions of the suspension 12 corresponding to the corners 112 of the vibration member 11 can be extended above the upper surface of the frame 13. In other words, the joining parts of the cushioning section 122 and the stretching section 121 define a plurality of peak points. The peak points of the suspension 12 corresponding to the corners 112 of the vibration member 11 can be located higher than the peak points corresponding to the edges of the vibration member 11, and may even higher than the plane of the upper surface of the frame 13. In other words, the peak points of the suspension 12 may protrude and extend out of the plane of the upper surface of the frame 13. The frame 13 may have arc inner surfaces at positions corresponding to the corners 112 to enhance the cushioning effect of the suspension 12 at the corners 112. The displacement of the vibration member 11 will not be limited. For a racetrack shaped suspension of a conventional art, the distortion at the corners will be most serious and the displacement length of the suspension is influenced. However, the acoustic unit 10 of the present invention does not have this disadvantage by means of the design described above, the desired audio effect is achieved and the whole structure is also durable.

It is worth mentioning that the shape of the vibration member 11 can be but not limited to a rectangular shape shown in FIGS. 1A to 6. The outer edge 111 also can be constructed to be triangle shaped, round shaped, or other polygonal shaped. When the outer edge 111 is constructed to be round shaped, the suspension 12 can be a circular ring provided around the vibration member 11.

Figure 7:
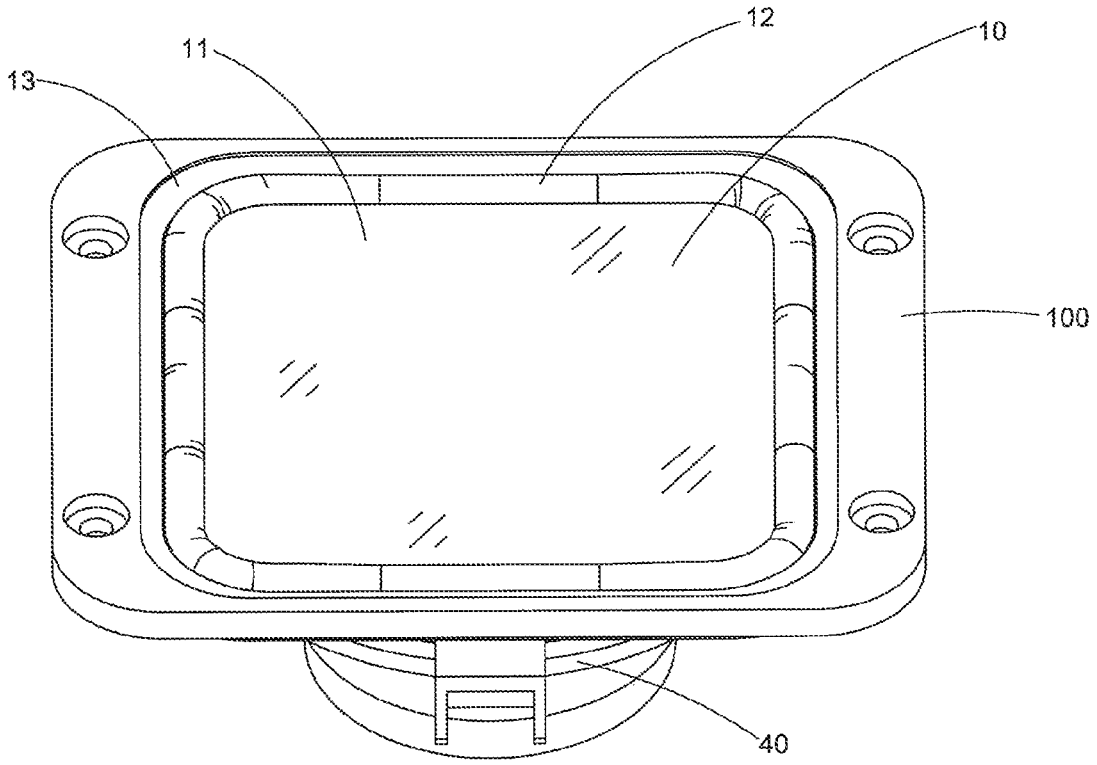
FIG. 7 a perspective view of a loudspeaker incorporated with the acoustic unit according to the above preferred embodiment of the present invention.
Figure 8:
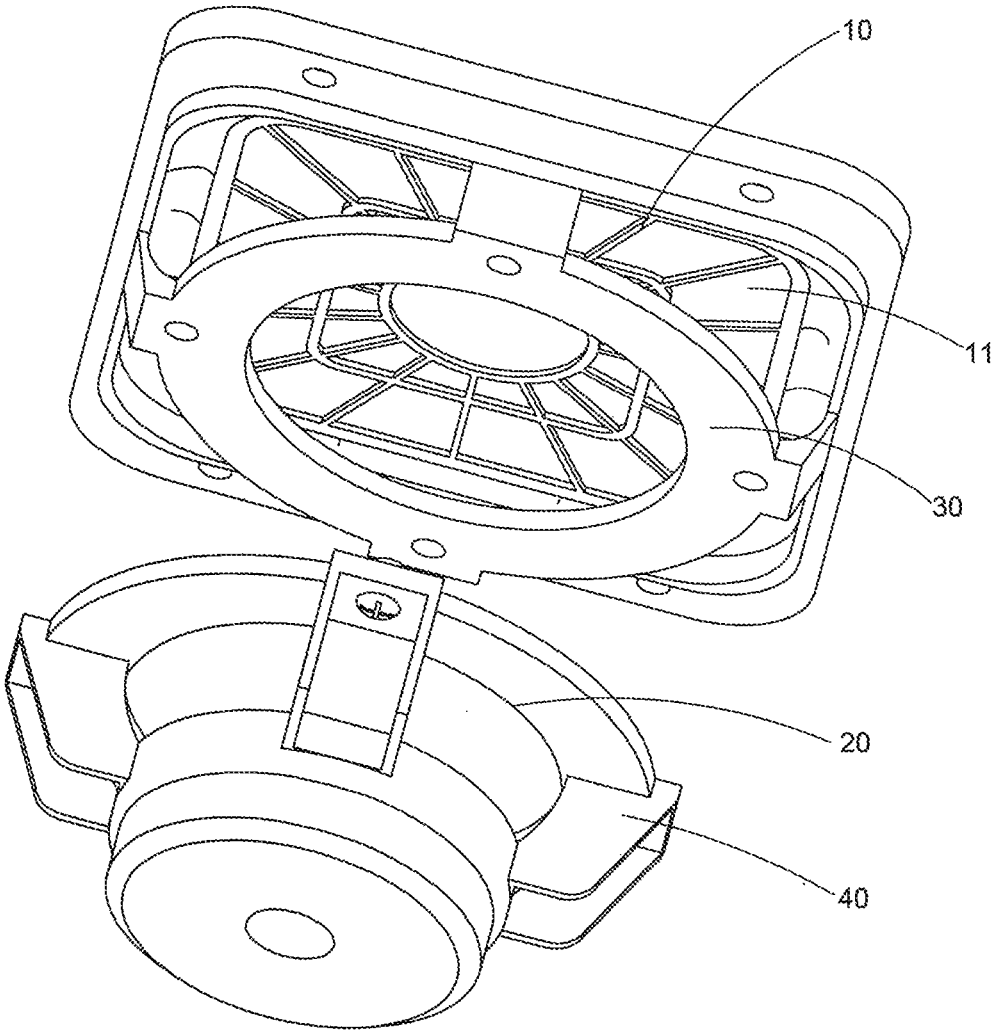
FIG. 8 is an exploded view of the loudspeaker incorporated with the acoustic unit according to the above preferred embodiment of the present invention.

Referring to FIGS. 7 and 8 of the drawings, a loudspeaker 100 incorporated with the acoustic unit 10 according to the preferred embodiment of the present invention is illustrated, wherein the loudspeaker 100 comprises the acoustic unit 10, a magnetic coil system 20, a voice coil 30 coupled with the acoustic unit 10, a base frame 40 and other necessary components. The frame 13 of the acoustic unit 10 can be integrally formed with the base frame 40, other a part of the base frame 40 can be formed as the frame 13 of the acoustic unit 10. The base frame 40 is coupled with the acoustic unit 10 and the magnetic coil system 20 which can be a magnet. The induction of the voice coil 30 and the magnetic coil system 20 will drive the vibration member 11 of the acoustic unit 10 to vibrate. Because the acoustic unit 10 has such a type of structure mentioned above, the suspension 12 will not distort seriously and the displacement of the vibration member 11 is also not interfered, so that the loudspeaker 100 can be provided with a desired audio quality, especially enhanced low frequency audio performance.

Figure 9:
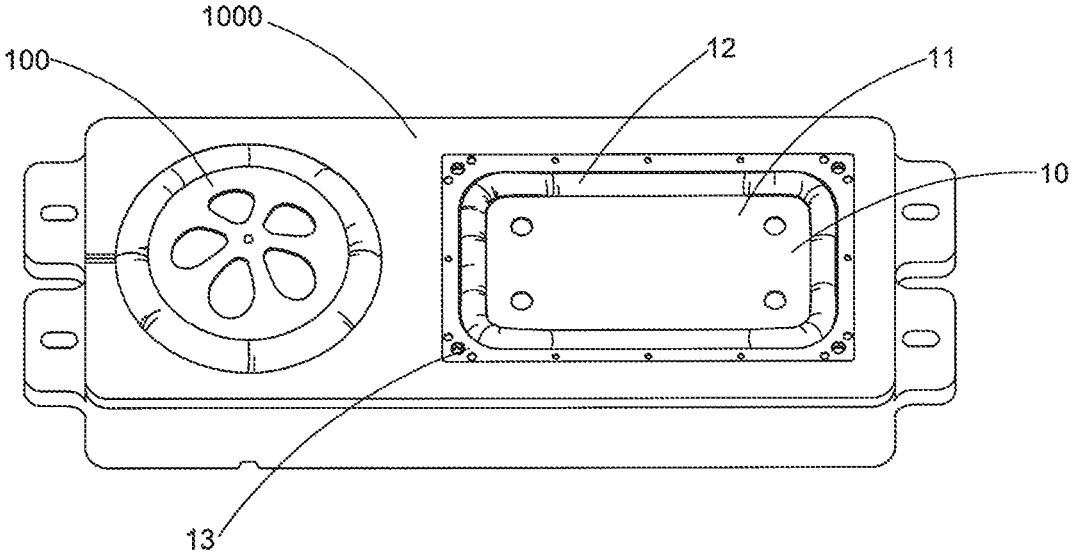
FIG. 9 is a perspective view of an acoustic module incorporated with the acoustic unit according to the above preferred embodiment of the present invention.
Figure 10:
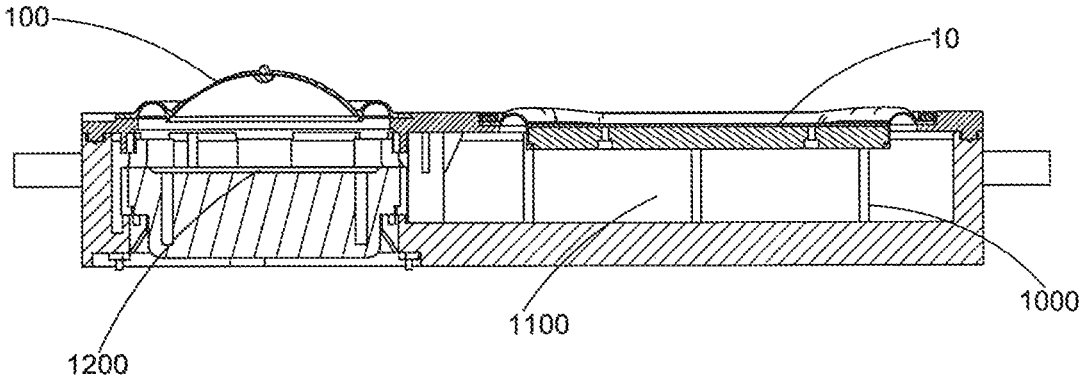
FIG. 10 is a schematic view illustrating the internal structure of the acoustic module incorporated with the acoustic unit according to the above preferred embodiment of the present invention.

As shown in FIGS. 9 and 10 of the drawings, the acoustic unit 10 can be used for manufacturing an acoustic module 1000. The acoustic module 1000 comprises at least one loudspeaker 100 and at least one acoustic unit 10. The acoustic unit 10 is provided adjacent to the loudspeaker 100 in such a manner that when the loudspeaker 100 vibrates, the air within the acoustic module 1000 simultaneously vibrates so as to drive the acoustic unit 10 to vibrate so as to produce an audio sound. As shown in FIG. 10 of the drawings, the acoustic module 1000 forms a first chamber 1100 for the acoustic unit 10 and a second chamber 1200 for the loudspeaker 100, wherein the first and second chambers 1100, 1200 are two air concealed chambers. The first chamber 1100 is communicated with the second chamber 1200, so that when the voice coil 30 and the magnetic coil system 20 of the loudspeaker 100 is a vibration operation, the air in the second chamber 1200 is forced to vibrate, the air in the first chamber 1100 will simultaneously vibrate so that the acoustic unit 10 is capable of providing a supplemental audio effect.

It is worth mentioning that the loudspeaker 100 may not be embodied as the structure shown in FIG. 8 of the drawings. The loudspeaker 100 can also be a conventional loudspeaker or a conventional speaker which comprises a vibration plate, when the vibrate plate vibrates, the acoustic unit 10 adjacent to the vibration plate will synchronously vibrate to provide a supplemental audio effect, particularly a low frequency audio effect, for the acoustic module 1000. In other words, the configuration of the acoustic unit 10 and the loudspeaker 100 enables the enhanced low frequency audio effect of the acoustic module 1000 by means of the vibration of the vibration member 11 of the acoustic unit 10. Therefore, unlike the conventional acoustic module 1000 which requires a relatively large volume and size to increase the vibration magnitude if a desired low frequency audio effect is to be obtained, the design of the present invention enables the acoustic module to be more small, exquisite, lightweight, and portable.

Figure 11:
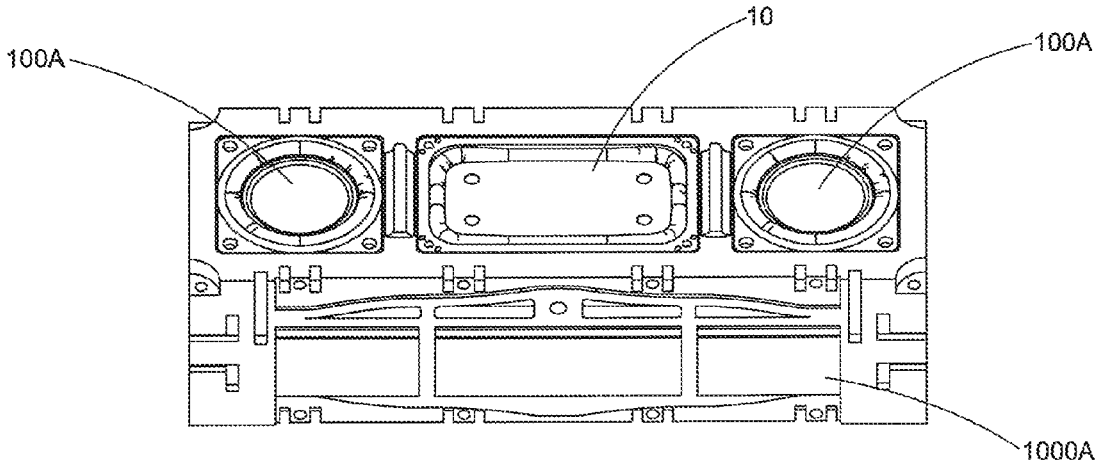
FIG. 11 is a perspective view of an acoustic module incorporated with the acoustic unit according to an alternative mode of the above preferred embodiment of the present invention.

Referring to FIG. 11 of the drawings, an acoustic module 1000A according to an alternative mode of the above preferred embodiment of the present invention is illustrated, the acoustic module 1000A comprises two loudspeaker 100A and an acoustic unit 10 formed between the two loudspeakers 100A. Similarly, when the two loudspeakers 100A are in a vibration operation to drive the air in the acoustic module 1000A to vibrate, the vibration member 11 of the acoustic unit 10 is also driven to vibrate, so that enhanced low frequency audio effect is provided, and thus the volume of the box body of the acoustic module 1000A can be minimized while the low frequency audio effect is still ensured.

Similarly, each of the loudspeakers 100A also can be manufactured by the acoustic unit 10 and other components as shown in FIGS. 7 and 8 of the drawings. Each loudspeaker 100A also can be constructed to be a conventional loudspeaker structure. The frame 13 of the acoustic unit 10 can be integrally coupled with the acoustic module 1000A. Alternatively, the frame 13 of the acoustic unit 10 is directly formed by a part of the acoustic module 1000A. In other words, the suspension 12 of the acoustic unit 10 can be directly connected to the case body of the acoustic module 1000A.

It is worth mentioning that the present invention further provides a method of manufacturing the acoustic unit, and the method comprises the following steps.

(a) Place a ring shaped rigid frame 13 in a shape forming mold.

(b) Place a vibration member 11 within the ring shaped rigid frame 13.

(c) Mold-inject a raw material into the mold to form a resilient suspension 12 between the vibration member 11 and the frame 13, such that the vibration member 11 are coupled with the frame 13 via the suspension 12 to form a one-piece structure.

The frame 13 may be made of iron or other metal materials.

The step (c) can be carried out in an injection molding process, and during the injection molding process, a resilient material layer 14 is coated on the vibration member 11 and the frame 13. The material of the resilient material layer 14 can be the same material of the suspension 12, for example, the material can be plastics.

The shape forming mold is corresponding provided with a suspension forming part which is constructed to be corrugated shaped so that the suspension 12 is formed with a stretching section 121, a cushioning section 122 extended from the stretching section 121. The joining part of the stretching section 121 and the cushioning section 122 is located above the plane of the outer surface of the vibration member 11.

A connecting section 123 can be formed between the frame 13 and the cushioning section 122. The connecting section 123 is connected with the frame 13 in such a manner that the connecting section 123 is extend from the cushion section 122 to an inner surface the frame 13. When the vibration member 11 synchronously moves with the stretching section 121, the pulling force of the vibration member 11 will not be transferred to the connecting section 121 by means of the cushioning effect of the cushioning section 122, so that the connecting section 123 will not displace so that the suspension 12 are not easy to be damaged.

Figure 12:
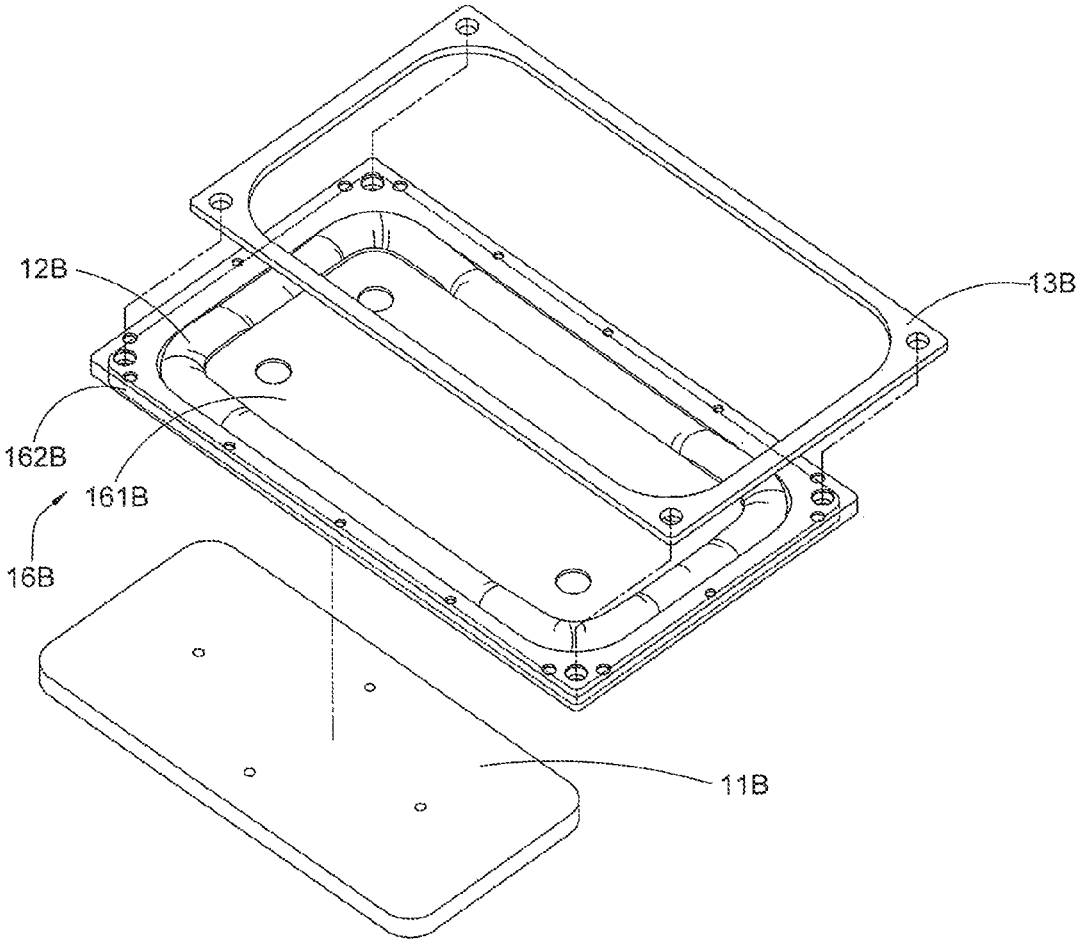
FIG. 12 is an exploded perspective view of an acoustic unit according a second embodiment of the present invention.
Figure 13:
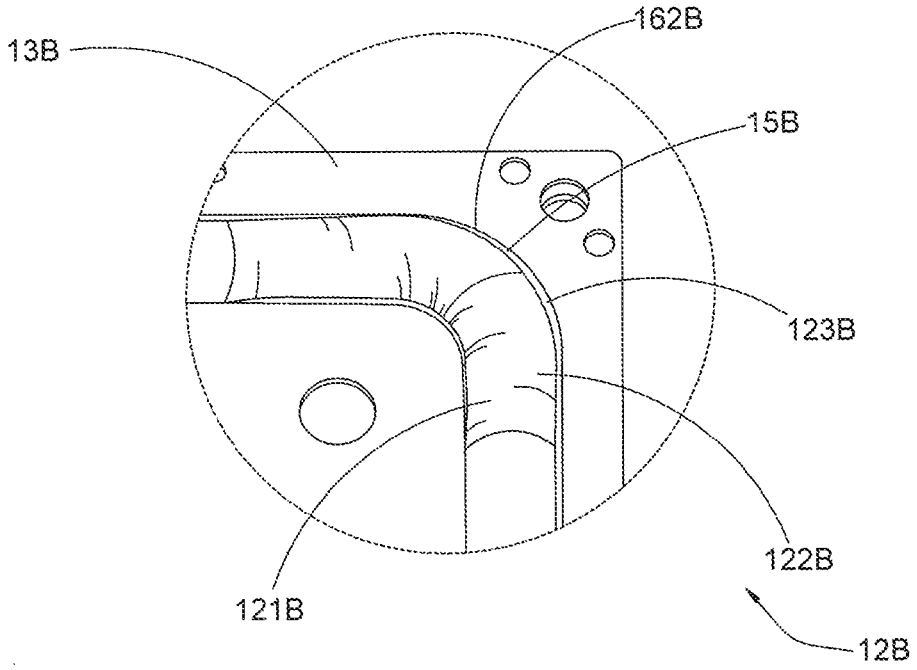
FIG. 13 is a partially enlarged view of the acoustic unit according the second embodiment of the present invention, illustrating the cushioning groove around the corner of the vibration member.

FIGS. 12 and 13 illustrate another embodiment of the present invention which is a further interpretation of the acoustic unit 10 in FIGS. 1 to 6. The acoustic unit 10B comprises a central vibration member 11B, a resilient suspension 12B provided around the vibration member 11B, and a frame 13B. The suspension 12B is provided between the vibration member 11B and the frame 13B. The vibration member 11B is preferably a piece of weight member having a predetermined thickness and defining a flat top surface and a flat bottom surface. It is worth mentioning that the racetrack shaped suspension 12B is defined to have a general rectangular shape with two longitudinal portions extended in parallel, two transverse portions extended in parallel, and four round corner portions extended between the longitudinal and transverse portions.

The acoustic unit 10B further comprises a suspension unit 16B to retain the suspension 12B in position between the vibration member 11B and the frame 13B. Accordingly, the suspension unit 16B comprises a center layer 161B integrally and inwardly extended within the suspension 12B and a boundary layer 162B integrally and outwardly extended from the suspension 12B. In other words, the cushioning section 122B of the suspension 12B is integrally extended from the boundary layer 162B while the stretching section 121B of the suspension 12B is integrally extended from the center layer 161B. In particular, the suspension 12B is integrally extended between the center layer 161B and the boundary layer 162B to form a one piece integrated structure. Preferably, the suspension unit 16B is made by mold injection to form the one piece integrated structure. The center layer 161B and the boundary layer 162B form the resilient material layer 14 affixed to the vibration member 11B and the frame 13B respectively.

The vibration member 11B is preferably affixed to the center layer 161B, such that the suspension 12B is extended to encircle around the vibration member 11B. In particular, the vibration member 11B is affixed to the bottom side of the center layer 161B. The vibration member 11B has a plurality of affixing posts upwardly extended therefrom, wherein the center layer 161B has a plurality of affixing slots arranged in such a manner that when the vibration member 11B is affixed to the center layer 161B, the affixing posts of the vibration member 11B are inserted into and sealed at the affixing slots of the center layer 161B respectively so as to secure the connection between the vibration member 11B and the center layer 161B. It is appreciated that the vibration member 11B can be affixed at the top side of the center layer 161B by any configuration such as glue. It is appreciated that the vibration member 11B can be embedded within the center layer 161B during mold injection, wherein the center layer 161B forms a pocket cavity to receive the vibration member 11B therein between an upper film and a bottom film of the center layer 161B.

The boundary layer 162B has a size and shape matching with the frame 13B, wherein the frame 13B is securely affixed on the top side of the boundary layer 162B. Accordingly, the connecting section 123B is defined at the boundary layer 162B to join with the frame 13B and to form the cushioning groove 15B is provided between the cushioning section 122B and the frame 13B. Therefore, after the frame 13B is affixed to the boundary layer 162B, the suspension 12B is retained in position to extend within the frame 13B. It is worth mentioning that through the suspension unit 16B, the suspension 12B is stably retained in position between the vibration member 11B and the frame 13B.

Figure 14:
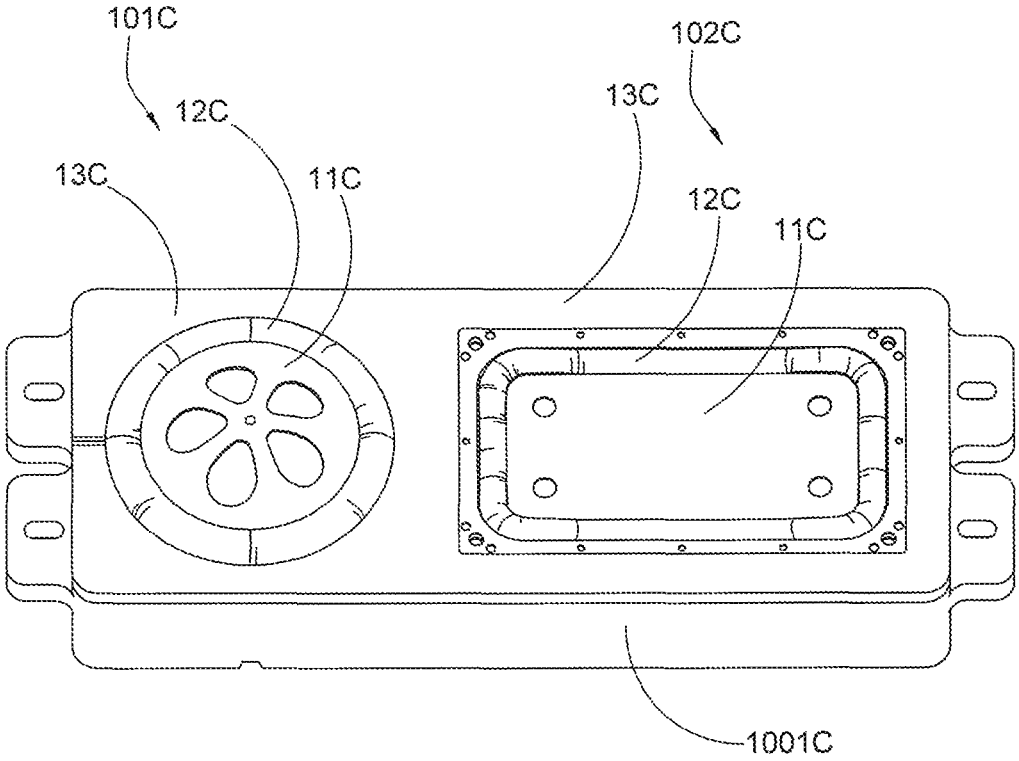
FIG. 14 is a perspective view of an acoustic module according a third embodiment of the present invention.
Figure 15:
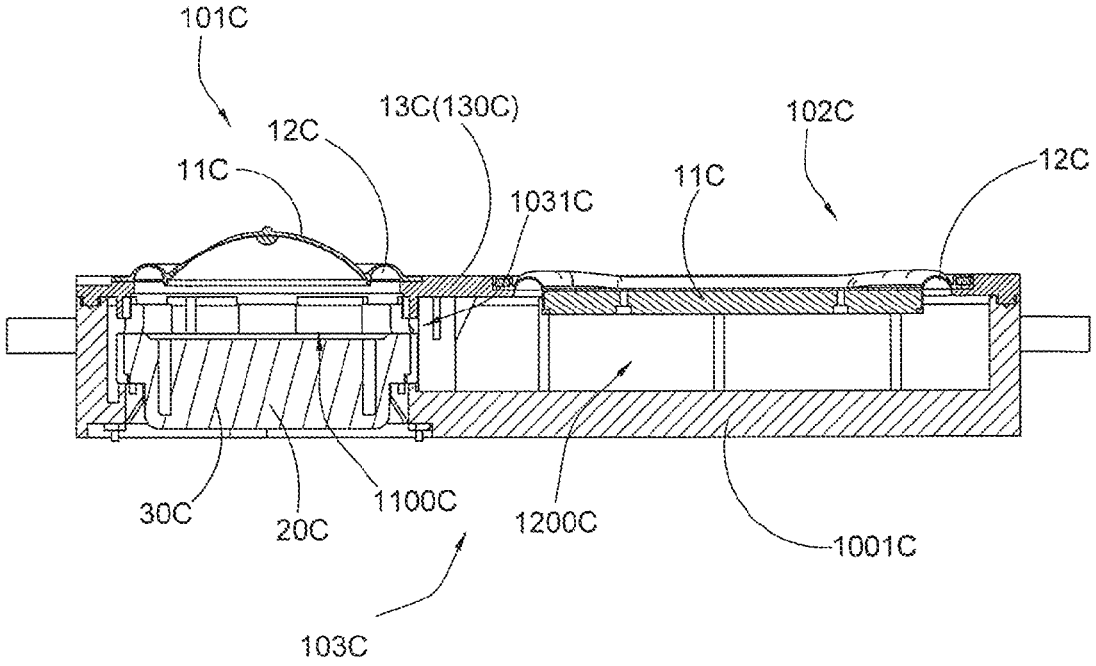
FIG. 15 is a sectional view of the acoustic module according the third embodiment of the present invention.

As shown in FIGS. 14 and 15, the acoustic module 1000C comprises a first acoustic unit 101C and a second acoustic unit 102C, wherein the configuration of each of the first and second acoustic units 101C, 102C can be the same as that of the acoustic unit 10, 10B. In other words, each of the first and second acoustic units 101C, 102C is configured to have the vibration member 11C, the suspension 12C, and the frame 13C.

Accordingly, the first acoustic unit 101C can be used for the loudspeaker while the second acoustic unit 102C can be used as a low frequency loudspeaker for reproduction of low-pitch audio frequencies.

The first and second acoustic units 101C, 102C share a common air sealing chamber 103C which has a predetermined air pressure concealed therein. When the vibration member 11C of the first acoustic unit 101C is reciprocatingly moved, i.e. moving up- and down or moving forward and backward, the air within the common air sealing chamber 103C is vibrate to cause the vibration of the vibration member 11C of the second acoustic unit 102C.

Figure 16:
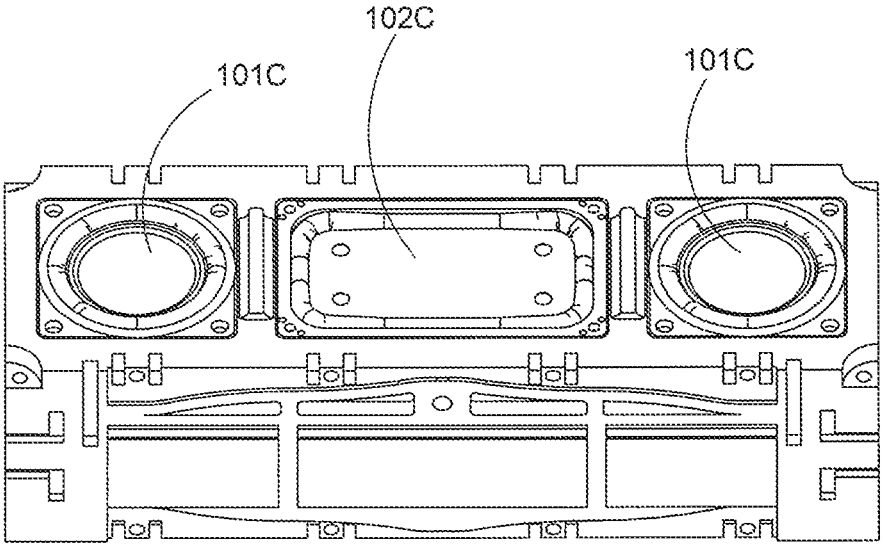
FIG. 16 illustrates an alternative mode of the acoustic module according the third embodiment of the present invention.

As shown in FIG. 16, the frames 13C of the first and second acoustic unit 101C, 102C are integrated with each other to form a common frame 130C in one single planar structure, wherein the vibration members 11C of the first and second acoustic units 101C, 102C are supported at the common frame 130C and located side-by-side.

The acoustic module 1000C further comprises an acoustic enclosure 1001C coupled at the back side of the common frame 130C to define the common air sealing chamber 103C between the common frame 130C and the acoustic enclosure 1001C. In particular, the first chamber 1100C is formed between the frame 13C of the first acoustic unit 101C and the acoustic enclosure 1001C. The second chamber 1200C is formed between the frame 13C of the second acoustic unit 102C and the acoustic enclosure 1001C. In other words, the first and second chambers 1100C, 1200C are combined to form the common air sealing chamber 103C, such that the first chamber 1100C is communicated with the second chamber 1200C. It is worth mentioning that the depth of the first chamber 1100C equals to the depth of the second chamber 1200C. In addition, the height of the acoustic enclosure 1001C is the same as the depth of each of the first and second chambers 1100C, 1200C.

For example, the loudspeaker 100 is formed when the first acoustic unit 101C is incorporated with the voice coil 30 and the magnetic coil system 20 of the vibration system. During the operation, the vibration member 11C of the first acoustic unit 101C is reciprocatingly moved via the electromagnetic force of the magnetic coil system 20 to regulate the air pressure within the common air sealing chamber 103C. In particular, the air pressure within the first chamber 1100C is regulated by the vibration member 11C of the first acoustic unit 101C. Since the first and second chambers 1100C, 1200C are air sealed chambers are communicated with each other, the change of the air pressure therewithin will shift from one to another. When the air pressure within the first chamber 1100C is reduced by moving the vibration member 11C of the first acoustic unit 101C into the first chamber 1100C, the air pressure within the second chamber 1200C will be correspondingly increased. As a result, the vibration member 11C of the second acoustic unit 102C will be pushed to move away from the second chamber 1200C.

Likewise, when the air pressure within the first chamber 1100C is increased by moving the vibration member 11C of the first acoustic unit 101C away from the first chamber 1100C, the air pressure within the second chamber 1200C will be correspondingly reduced. As a result, the vibration member 11C of the second acoustic unit 102C will be pulled to move into the second chamber 1200C. In other words, when the vibration member 11C of the first acoustic unit 101C is reciprocatingly moved, the vibration member 11C of the second acoustic unit 102C will be reciprocatingly moved correspondingly. Since the vibration members 11C of the first and second acoustic units 101C, 102C are synchronously vibrated via the common air sealing chamber 103C, the volume of the common air sealing chamber 103C can be minimized to substantially reduce the size of the acoustic enclosure 1001C. It is worth mentioning that the second acoustic unit 102C can be formed a low frequency loudspeaker for generating booming sound effect. It is worth mentioning that the height of the vibration system is slightly smaller than the height of the acoustic enclosure 1001C, such that the size of the acoustic enclosure 1001C can be substantially minimized.

In order to enhance sound quality of the low frequency loudspeaker, the acoustic module 1000C can comprise three acoustic units as shown in FIG. 16. Preferably, there are two first acoustic units 101C and one second acoustic unit 102C, wherein the second acoustic unit 102C is located between the two first acoustic units 101C. The two first acoustic units 101C can be used for the loudspeaker while the second acoustic unit 102C can be used as a low frequency loudspeaker for reproduction of low-pitch audio frequencies. It should be appreciated that the acoustic module 1000C can have a plurality of first and second acoustic units 101C, 102C.

The first and second acoustic units 101C, 102C share a common air sealing chamber 103C that the second chamber 1200C is communicated with and located between the two first chambers 1100C. In particular, a communicating channel 1031C is formed within the common air sealing chamber 103C to communicate between the first and second chambers 1100C, 1200C. In other words, the air pressure at the first and second chambers 1100C, 1200C is shifted therebetween through the communicating channel 1031C. When the air pressure within the first chambers 1100C is reduced by moving the vibration members 11C of the first acoustic units 101C into the first chambers 1100C respectively, the air pressure within the second chamber 1200C will be correspondingly increased. As a result, the vibration member 11C of the second acoustic unit 102C will be pushed to move away from the second chamber 1200C.

Likewise, when the air pressure within the first chambers 1100C is increased by moving the vibration members 11C of the first acoustic units 101C away from the first chambers 1100C respectively, the air pressure within the second chamber 1200C will be correspondingly reduced. As a result, the vibration member 11C of the second acoustic unit 102C will be pulled to move into the second chamber 1200C. It is worth mentioning that when the air pressure within the first chambers 1100C is reduced, the air pressures at the first chambers 1100C will shift to the second chamber 1200C concurrently. Therefore, the shifted air pressures will be doubled to drive the vibration member 11C of the second acoustic unit 102C to move so as to enhance the booming sound effect generated by the second acoustic unit 102C.

Figure 17:
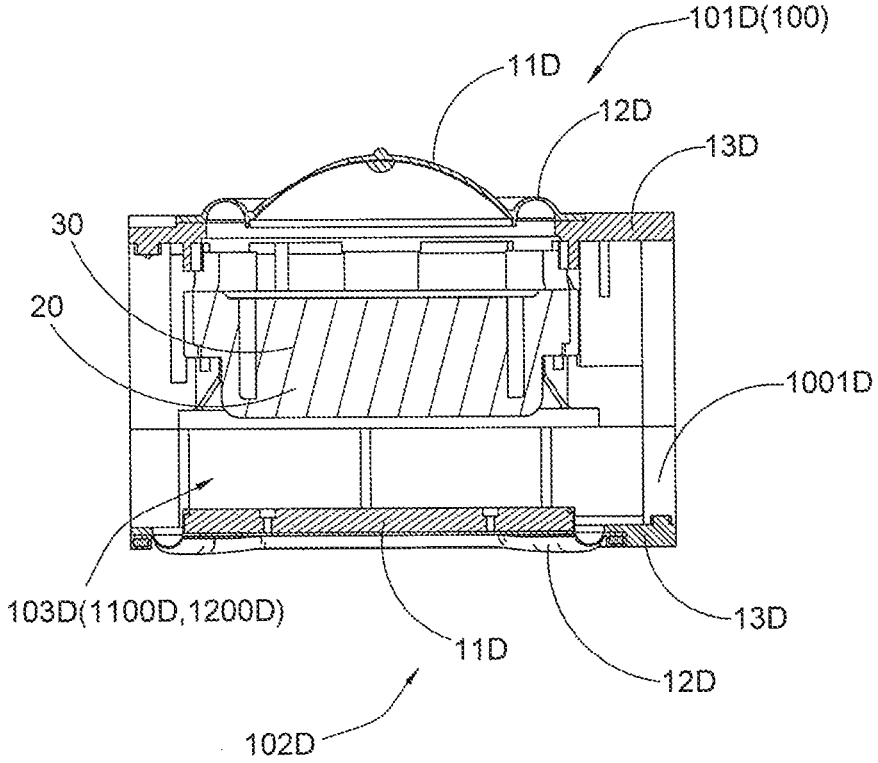
FIG. 17 is a sectional view of an acoustic module according a fourth embodiment of the present invention.

FIG. 17 illustrates an alternative mode of the acoustic module 1000D which comprises a first acoustic unit 101D and a second acoustic unit 102D. The configuration of each of the first and second acoustic units 101D, 102D can be the same as that of the acoustic unit 10, 10B. In other words, each of the first and second acoustic units 101D, 102D is configured to have the vibration member 11D, the suspension 12D, and the frame 13D. Accordingly, the first acoustic unit 101D can be used for the loudspeaker while the second acoustic unit 102D can be used as a low frequency loudspeaker for reproduction of low-pitch audio frequencies.

The first and second acoustic units 101D, 102D are coupled with each other back-to-back. In particular, the vibration members 11D of the first and second acoustic units 101D, 102D are supported back-to-back. The rear side of the frame 13D of the first acoustic unit 101D is coupled with the rear side of the frame 13D of the second acoustic unit 102D to form the acoustic enclosure 1001D, such that the first and second acoustic units 101D, 102D share a common air sealing chamber 103D which has a predetermined air pressure concealed within the acoustic enclosure 1001D. In other words, the first chamber 1100D of the first acoustic unit 101D is the second chamber 1200D of the second acoustic unit 102D, which is also the common air sealing chamber 103D.

For example, the loudspeaker 100 is formed when the first acoustic unit 101D is incorporated with the voice coil 30 and the magnetic coil system 20. During the operation, the vibration member 11D of the first acoustic unit 101D is reciprocatingly moved via the electromagnetic force of the magnetic coil system 20 to regulate the air pressure within the common air sealing chamber 103D.

In particular, the air pressure within the first chamber 1100D is regulated by the vibration member 11D of the first acoustic unit 101D. Since the first and second chambers 1100D, 1200D are air sealed chambers are communicated with each other, the change of the air pressure therewithin will shift from one to another. In other words, when the vibration member 11D of the first acoustic unit 101D is reciprocatingly moved, the vibration member 11D of the second acoustic unit 102D will be reciprocatingly moved correspondingly via the common air sealing chamber 103D.

It is worth mentioning that the height of the vibration system is slightly smaller than the height of the acoustic enclosure 1001D, i.e. the depth of the common air sealing chamber 103D, such that the size of the acoustic enclosure 1001D can be substantially minimized.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An acoustic module, comprising:

at least a first acoustic unit defining a first chamber;

at least a second acoustic unit defining a second chamber, wherein each of said first and second acoustic units comprises a frame, a vibration member, and a suspension provided around said vibration member and is located between said vibration member and said frame to enable said vibration member to be reciprocatingly moved, wherein said first chamber and said second chamber combine and share to form a common air sealing chamber that a depth of said first chamber equals to a depth of said second chamber, such that when said vibration member of said first acoustic unit is reciprocatingly moved, said vibration member of said second acoustic unit is driven to reciprocatingly move by means of shifting air pressure through said common air sealing chamber; and an acoustic enclosure coupled with said frames to enclose said common air sealing chamber, wherein a height of said acoustic enclosure is the same as a depth of said common air sealing chamber.

2. The acoustic module, as recited in claim 1, further comprising a vibration system operatively coupled with said first acoustic unit to form a loudspeaker, wherein said vibration member of said first acoustic unit is reciprocatingly moved in response to said vibration in order to drive said vibration member of said second acoustic unit to reciprocatingly move correspondingly.

3. The acoustic module, as recited in claim 1, wherein said frames of said first and second acoustic unit are integrated with each other to form a common frame in one single planar structure, wherein said acoustic enclosure is coupled at a back side of said common frame to enclose said common air sealing chamber, wherein said vibration members of said first and second acoustic units are supported at said common frame and located side-by-side.

4. The acoustic module, as recited in claim 2, wherein said frames of said first and second acoustic unit are integrated with each other to form a common frame in one single planar structure, wherein said acoustic enclosure is coupled at a back side of said common frame to enclose said common air sealing chamber, wherein said vibration members of said first and second acoustic units are supported at said common frame and located side-by-side.

5. The acoustic module, as recited in claim 1, wherein said first and second acoustic units are coupled back-to-back that said vibration members of said first and second acoustic units are supported back-to-back, wherein said frame of said first acoustic unit is coupled at a front side of said acoustic enclosure and said frame of said second acoustic unit is coupled at a rear side of said acoustic enclosure to enclose said common air sealing chamber.

6. The acoustic module, as recited in claim 2, wherein said first and second acoustic units are coupled back-to-back that said vibration members of said first and second acoustic units are supported back-to-back, wherein said frame of said first acoustic unit is coupled at a front side of said acoustic enclosure and said frame of said second acoustic unit is coupled at a rear side of said acoustic enclosure to enclose said common air sealing chamber.

7. An operating method of an acoustic module which comprises at least a first acoustic unit having a first chamber and at least a second acoustic unit having a second chamber, wherein each of said first and second acoustic units comprises a vibration member, a frame, and a suspension extended between said vibration member and said frame, wherein the method comprises the steps of:

(a) combining and sharing said first and second chambers of said first and second acoustic units to form a common air sealing chamber that a depth of said first chamber equals to a depth of said second chamber; and (b) coupling an acoustic enclosure coupled with said frames to enclose said common air sealing chamber, wherein a height of said acoustic enclosure is the same as a depth of said common air sealing chamber; and (c) reciprocatingly moving said vibration member of said first acoustic unit to drive said vibration member of said second acoustic unit to reciprocatingly move by means of shifting air pressure through said common air sealing chamber.

8. The method, as recited in claim 7, further comprising a step of operatively coupling a vibration system with said first acoustic unit to form a loudspeaker, wherein said vibration member of said first acoustic unit is reciprocatingly moved in response to said vibration in order to drive said vibration member of said second acoustic unit to reciprocatingly move correspondingly.

9. The method, as recited in claim 7, wherein the step (a) further comprising the steps of:

integrally coupling said frames of said first and second acoustic unit with each other to form a common frame in one single planar structure;

coupling said acoustic enclosure at a back side of said common frame to enclose said common air sealing chamber; and supporting said vibration members of said first and second acoustic units at said common frame side-by-side.

10. The method, as recited in claim 8, wherein the step (a) further comprising the steps of:

integrally coupling said frames of said first and second acoustic unit with each other to form a common frame in one single planar structure;

coupling said acoustic enclosure at a back side of said common frame to enclose said common air sealing chamber; and supporting said vibration members of said first and second acoustic units at said common frame side-by-side.

11. The method, as recited in claim 7, wherein the step (a) further comprising the steps of:

coupling said frames of said first and second acoustic units with each other back-to-back at a position that said frame of said first acoustic unit is coupled at a front side of said acoustic enclosure and said frame of said second acoustic unit is coupled at a rear side of said acoustic enclosure to enclose said common air sealing chamber; and supporting said vibration members of said first and second acoustic units back-to-back to communicate said first and second chambers.

12. The method, as recited in claim 8, wherein the step (a) further comprising the steps of:

coupling said frames of said first and second acoustic units with each other back-to-back at a position that said frame of said first acoustic unit is coupled at a front side of said acoustic enclosure and said frame of said second acoustic unit is coupled at a rear side of said acoustic enclosure to enclose said common air sealing chamber; and supporting said vibration members of said first and second acoustic units back-to-back to communicate said first and second chambers.

* * * * *